United States Patent [19]

Lobell et al.

[11] Patent Number: 4,637,213

[45] Date of Patent: Jan. 20, 1987

[54] ARRANGEMENT FOR A SUBMARINE VEHICLE

[75] Inventors: Hans Lobell, Motala; Klas G. Svensson, Borensberg; Göran Gladh, Motala; Björn Höglander, Vadstena, all of Sweden

[73] Assignee: Affarsverket FFV, Eskilstuna, Sweden

[21] Appl. No.: 690,055

[22] Filed: Jan. 9, 1985

[30] Foreign Application Priority Data

Jan. 12, 1984 [SE] Sweden ..... 8400134

[51] Int. Cl.[4] ..... F01K 9/00

[52] U.S. Cl. ..... 60/685; 60/668; 114/20.2

[58] Field of Search ..... 60/39.52, 39.55, 668, 60/670, 685, 687, 690, 692; 114/20 A, 20 R, 337

[56] References Cited

U.S. PATENT DOCUMENTS

| | | | |
|---|---|---|---|
| 265,423 | 10/1882 | Kellogg | 60/668 X |
| 1,236,793 | 8/1917 | Warman | 114/20 A |
| 1,291,355 | 1/1919 | Anderson | 60/690 X |
| 3,069,527 | 12/1962 | Kovacik | 114/20 A |
| 3,145,678 | 8/1964 | Shmorhun et al. | 248/632 X |
| 3,838,658 | 10/1974 | Faeth | 114/20 R |

FOREIGN PATENT DOCUMENTS

| | | | |
|---|---|---|---|
| 579125 | 7/1946 | United Kingdom | 114/337 |

*Primary Examiner*—Stephen F. Husar

*Attorney, Agent, or Firm*—Fleit, Jacobson, Cohn & Price

[57] ABSTRACT

Arrangement for a thermal, steam-powered engine in a submarine vehicle, for example a torpedo. A condenser is so arranged as to separate the exhaust from the engine into a condensable exhaust fraction and into a non-condensable exhaust fraction. A compressor, which is connected to the engine for the purpose of silencing, is so arranged as to compress only the non-condensable exhaust fraction which, after compression, is discharged through an exhaust outlet into the surrounding sea water. The condenser is in the form of a sleeve which for silencing purposes encloses both the engine and the compressor. A sound-deadening gap is arranged between the condenser and the hull of the vehicle.

6 Claims, 3 Drawing Figures

ARRANGEMENT FOR A SUBMARINE VEHICLE

BACKGROUND OF THE INVENTION

1. Field of the Invention

The present invention relates to an arrangement for a submarine vehicle, comprising a thermal, steam-powered engine, a condenser for condensing the exhaust given off by the engine, a compressor for compressing a non-condensable fraction of the exhaust, and an exhaust outlet for draining the compressed exhaust fraction into the water surrounding the vessel. The expression submarine vessel is used here to denote primarily, but not exclusively, a torpedo.

2. Description of the Prior Art

In conventional submarine torpedos, which are powered by thermal engines, an arrangement is provided which generates water vapour by burning a fuel, usually a liquid hydrocarbon. The oxygen for the combustion process is taken from an accompanying oxygen supply, for example air, hydrogen peroxide or liquid oxygen. The gases produced by combustion and the water vapour generated at a high temperature are led into the engine and are converted into mechanical work. The exhaust gases from the engine are usually discharged at a point on top of the extreme stern of the torpedo.

If the exhaust gases are to leave the torpedo, then the gas pressure must be higher than the existing depth pressure. Since the torpedoes must be capable of being used against targets moving at different depths, they are fitted with an adjustable depth regulator. When the torpedo is set for a greater depth, the depth pressure which the exhaust gases must overcome will also be greater. A high back-pressure will reduce the operating efficiency (power output) of the torpedo engine and will increase the noise level due to the fact that the pressure inside the operating cylinder of the engine will be high when the outlet to the sea is opened.

It has accordingly been proposed, see U.S. Pat. No. 3,973,392, that only the non-condensable fraction of the exhaust gas be drained, instead of draining all the exhaust. Since the former usually constitutes only a small proportion of the exhaust gas, it will consequently be necessary to sacrifice only a very small amount of energy in order to expel the exhaust gas from the torpedo.

It has been found, however, that the noise radiated by the engine is troublesome even in torpedoes of this kind.

SUMMARY OF THE INVENTION

The object of the present invention is, therefore, without affecting the efficiency and the power output of the engine, to produce an arrangement of the kind indicated by way of introduction, in which the noise level is significantly reduced.

This object has been achieved by endowing the arrangement in accordance with the invention with the characteristic features wherein an arrangement for a submarine vehicle includes a thermal, steam-powered engine, a condenser for condensing the exhaust given off by the engine, a compressor for compressing a non-condensable fraction of the exhaust and an exhaust outlet for draining the compressed exhaust fraction into the water surrounding the vessel. The condenser is in the form of a sleeve which encloses both the engine and the compressor.

BRIEF DESCRIPTION OF THE DRAWINGS

The invention is described in greater detail below with reference to the accompanying drawing, which shows a preferred embodiment of the invention.

DESCRIPTION OF THE PREFERRED EMBODIMENT

Figure 1:
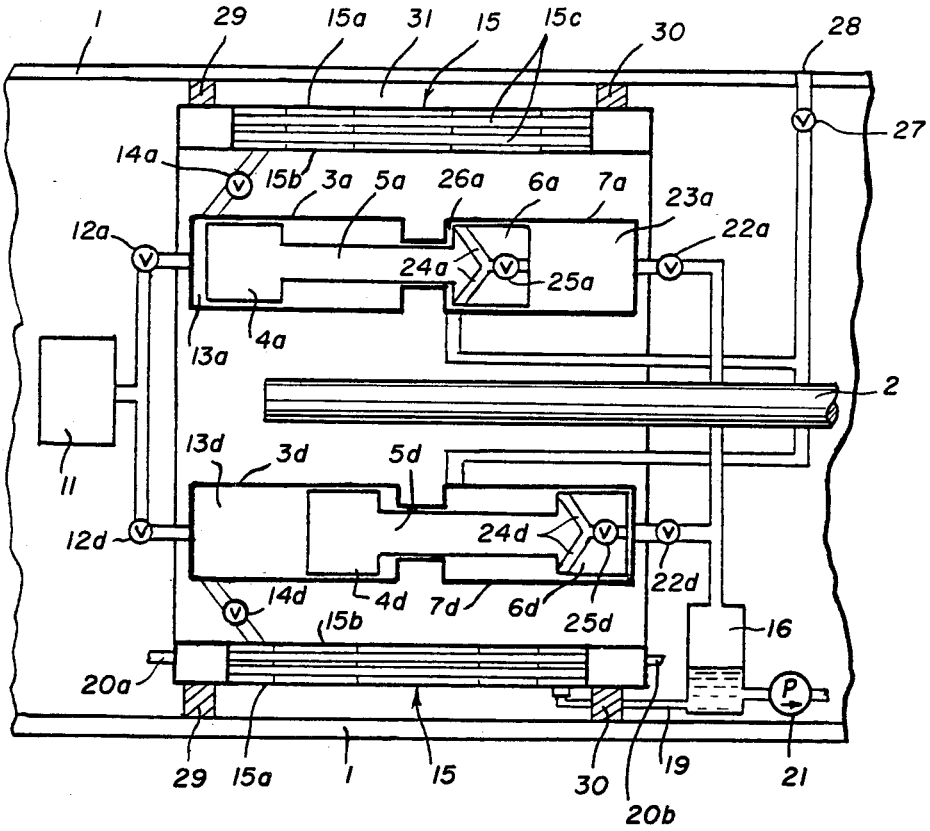
FIG. 1 shows in diagrammatic form the relative arrangement of two operating cylinders and two compressor cylinders with the associated condenser which forms part of one embodiment of the arrangement in accordance with the invention.
Figure 3:
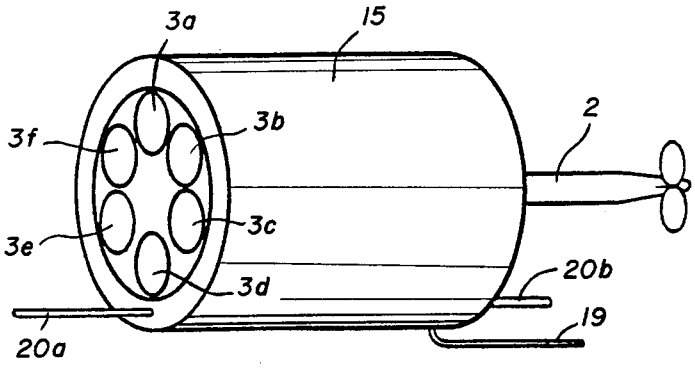
FIG. 3 shows in perspective view the condenser included in the arrangement in accordance with FIG. 1.

FIG. 1 shows a section of the hull 1 of a torpedo. An only partially shown propeller shaft 2 is driven by a thermal engine consisting of a number, being in the example shown six (see FIG. 3), of operating cylinders 3*a–f* of mutually identical execution, which are positioned in an evenly distributed fashion around the shaft 2. For technical reasons to do with the drawing, only the cylinders 3*a* and 3*d* are shown in FIG. 1. Each cylinder 3*a–f* has an operating piston 4*a–f* which is connected via a piston rod 5*a–f* to a compressor piston 6*a–f* in a compressor cylinder 7*a–f*. All the compressor cylinders are also of mutually identical execution. The pistons 4*a–f* and 6*a–f* are fitted with seals (not shown).

The pistons 4*a–f* interact with each other by each piston being provided with an inclined roller 8*a–f* (see FIG. 2) which bears against a cam 9 which is common to the rollers 8*a–f* and which is secured to the propeller shaft 2. The flank 10 of the cam 9 is of sinusoidal form, thereby endowing the pistons 8*a–f* with a sinusoidal movement.

A steam generator 11 is so arranged as to produce a propellant gas channelled to the rear cylinder chambers 13*a–f* of the operating cylinders via valves 12*a–f* in a predetermined cycle, for example controlled by an inlet cam (not shown) mounted on the shaft 2.

Each of the cylinder chambers 13*a–f* is connected via its own exhaust valve 14*a–f*, the opening and closing period of which can be controlled by a cam (not shown) (which may be mounted on the shaft 2) to a condenser 15 of open, tubular form at both ends which is arranged in the longitudinal sense of the vehicle and which fully encloses the operating and compressor cylinders.

The inlet and outlet valves 12*a–f* and 14*a–f* may as an alternative be replaced by rotary slide valves made of a suitable ceramic material.

The condenser 15 consists of an outer and an inner tubular jacket 15*a* and 15*b*, between which jackets a large number of axial tubes 15*c*, cooled internally by means of water, is installed. The condenser 15 thus forms a kind of sleeve which encloses the engine co-axially, as may be appreciated from FIG. 3. Significant sound-deadening is achieved in this way. This sound-deadening is augmented by the fact that the operating and compressor cylinders are combined together in the manner described above.

A collecting vessel 16 is provided to receive the condensate from the condenser 15.

The function of the arrangement is as follows.

Figure 2:
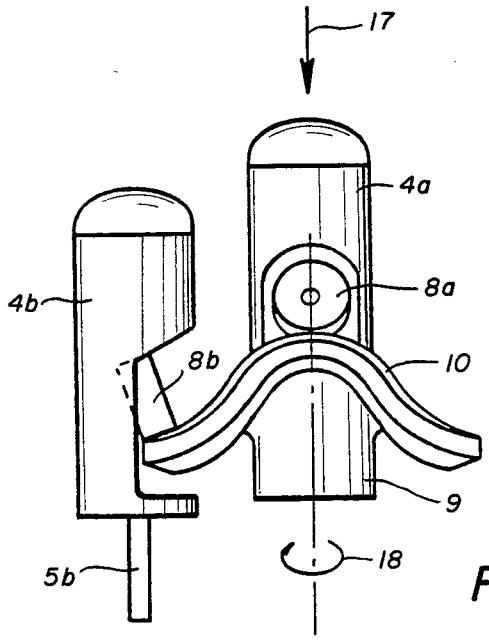
FIG. 2 shows in diagrammatic form the manner in which the operating cylinders in accordance with FIG. 1 interact with each other with the help of a cam.

When propellant gas enters the cylinder chamber 13*a*, the piston 4*a* moves over its operating stroke to the right in FIG. 1, that is to say in the direction of the arrow 17 in FIG. 2. The power is transmitted via the roller 8*a* to the cam 9 in such a way that the latter is caused to rotate in the direction of the arrow 18 (see FIG. 2) and to drive the propeller shaft 2.

When the piston 4*a* then moves over its return stroke to the left in FIG. 1, the exhaust gas is expelled from the cylinder chamber 13*a* via the valve 14*a* and into the condenser 15.

The condensation water from the condenser 15 is drained off via a connecting pipe 19 to the collecting vessel 16, where the non-condensable fraction of the exhaust gas, usually $CO_2$, is separated from the condensate. The condenser is cooled by water which is fed to and from the condenser via pipes 20*a* and 20*b* shown here only in part. The cooling water can be taken in a previously disclosed fashion from the surrounding sea waer, whereby no energy need be sacrificed from the function of the condenser. The condensate in the vessel 16 can be pumped by means of a pump 21 back into the propellant gas generating system of the torpedo in a fashion which is not illustrated in detail here.

The non-condensable fraction of the exhaust gas can be compressed in one or more stages. According to the embodiment shown here, compression takes place in two stages in the following manner.

As the piston 4*a* moves to the left in FIG. 1, the exhaust gas ($CO_2$) is sucked from the vessel 16 through a non-return valve 22*a* which opens into the front cylinder chamber 23*a* of the cylinder 7*a*. As the piston 4*a* then moves to the right, the exhaust gas is compressed in the cylinder chamber 23*a*, causing it to flow through the channel 24*a* in the piston 6*a* via an open non-return valve 25*a* and into the rear cylinder chamber 26*a* of the cylinder 7*a*. When the piston 6*a* subsequently moves to the left, the exhaust gas in the cylinder chamber 26*a* is compressed to a pressure which exceeds the depth pressure of the surrounding water and is forced through a non-return valve 27 to an exhaust outlet 28 in the hull 1, through which the fraction of the exhaust gas thus compressed is released into the surrounding water.

The engine, that is to say the cylinders, the steam generator, the condenser and the associated components, are preferably suspended inside the hull 1 of the torpedo on damping elements (not shown). The condenser 15 is also supported on damping elements 29 and 30 at both its ends, so that a gap 31 is formed between the outside of the condenser and the hull 1 of the torpedo. This gap is either air-filled or is filled with some kind of sound-absorbing material so as further to reduce the noise level.

The piston rod 5*a–f* should preferably be made relatively thin so as to enable it to provide a certain amount of flexibility or springing in a radial sense. In this way any centre deviations between the operating and compressor cylinders will be compensated for, in such a way as to eliminate the risk of undesired noise.

What is claimed is:

1. In a power plant for a submarine vehicle, a thermal engine, said engine having at least one operating cylinder and an exhaust gas outlet, an operating piston reciprocatable within said operating cylinder, compressor means for compressing exhaust gases from said engine, said compressor means having at least one compressor cylinder and an exhaust gas outlet, a compressor piston reciprocatable within said compressor cylinder, said compressor piston connected to said operating piston, and means for drainage of compressed exhaust gases from said compressor into the water surrounding said vehicle, said operating piston and said compressor piston being interconnected by means of a flexible piston rod.

2. A power plant for a submarine vehicle according to claim 1, said power plant including means for collecting exhaust gases from said engine, condenser means for condensing exhaust gases collected by said collecting means, means for separation of non-condensable exhaust gases from said condenser means, said compressor means being operative for compressing said non-condensable exhaust gases.

3. A power plant for a submarine vehicle according to claim 1, said power plant including, condenser means for condensing exhaust gases from said engine, said condenser means being in the form of a sleeve and mounted longitudinally of said vehicle, said engine and said compressor means being both mounted within said sleeve.

4. In a power plant for a submarine vehicle, a thermal engine, said engine having at least one operating cylinder and an exhaust gas outlet, an operating piston reciprocatable within said operating cylinder, compressor means for compressing exhaust gases from said engine, said compressor means having at least one compressor cylinder and an exhaust gas outlet, a compressor piston reciprocatable within said compressor cylinder, said compressor piston connected to said operating piston, and means for drainage of compressed exhaust gases from said compressor into the water surrounding said vehicle, said engine having a hull, a condenser sleeve spaced inwardly of said hull in order to define a gap therebetween, said gap containing noise-reducing means.

5. A power plant for a submarine vehicle according to claim 4, said power plant including, means for collecting exhaust gases from said engine, condenser means for condensing exhaust gases collected by said collecting means, means for separation of non-condensable exhaust gases from said condenser means, said compressor means being operative for compressing said non-condensable exhaust gases.

6. A power plant for a submarine vehicle according to claim 4, said power plant including, condenser means for condensing exhaust gases from said engine, said condenser means being in the form of a sleeve and mounted longitudinally of said vehicle, said engine and said compressor means being both mounted within said sleeve.

* * * * *